US008584730B1

(12) United States Patent
Aderinto

(10) Patent No.: US 8,584,730 B1
(45) Date of Patent: Nov. 19, 2013

(54) EASY BLINDS

(76) Inventor: Grace F. Aderinto, Spokane, WA (US)

( * ) Notice: Subject to any disclaimer, the term of this patent is extended or adjusted under 35 U.S.C. 154(b) by 0 days.

(21) Appl. No.: 13/599,392

(22) Filed: Aug. 30, 2012

(51) Int. Cl.
*E06B 9/36* (2006.01)

(52) U.S. Cl.
USPC ..... 160/168.1 P; 160/176.1 P; 160/DIG. 17

(58) Field of Classification Search
USPC ..... 160/168.1 P, 176.1 P, 168.1 V, 176.1 V, 160/900, 173 V, 177 V, 331, DIG. 17
See application file for complete search history.

(56) References Cited

U.S. PATENT DOCUMENTS

| | | | | | |
|---|---|---|---|---|---|
| 3,045,747 | A | * | 7/1962 | Hill | 160/331 |
| 3,327,194 | A | * | 6/1967 | Trapp | 318/282 |
| 3,502,132 | A | * | 3/1970 | Hager et al. | 160/331 |
| 3,879,800 | A | * | 4/1975 | Adams | 16/96 D |
| 4,773,464 | A | * | 9/1988 | Kobayashi | 160/168.1 P |
| 4,896,713 | A | | 1/1990 | Rademacher | |
| 4,993,469 | A | * | 2/1991 | Moench | 160/168.1 P |
| 5,270,629 | A | | 12/1993 | Hsieh | |
| 5,467,808 | A | * | 11/1995 | Bell | 160/168.1 P |
| 5,524,692 | A | * | 6/1996 | John | 160/168.1 R |
| 5,603,371 | A | | 2/1997 | Gregg | |
| D392,490 | S | | 3/1998 | Kimata et al. | |
| 6,112,798 | A | | 9/2000 | Cheng | |
| 6,405,782 | B1 | * | 6/2002 | Cheng | 160/168.1 P |
| 7,517,609 | B2 | * | 4/2009 | Cheng | 429/97 |
| 2003/0168187 | A1 | * | 9/2003 | Wen et al. | 160/168.1 P |
| 2005/0241780 | A1 | | 11/2005 | Coleman | |

* cited by examiner

*Primary Examiner* — David Purol

(57) ABSTRACT

A vertical window blind assembly remotely controls vertical window blinds. The assembly includes an elongated housing having an elongated opening. An elongated track having spaced channels is coupled to and positioned in the housing above the opening in the housing. Each of a plurality of rollers has a pair of spaced wheels positioned in a pair of channels of the track. Each of a plurality of blinds is coupled to the rollers. A telescopic arm is positioned in the housing extending in laterally parallel spaced relationship to the track. The telescopic arm is coupled to each of the rollers to distribute the rollers in spaced relationship along the track. An extension motor retracts and extends the telescopic arm. A remote control is operationally coupled to the extension motor for selectively actuating the extension motor.

20 Claims, 9 Drawing Sheets

EASY BLINDS

BACKGROUND OF THE DISCLOSURE

Field of the Disclosure

The disclosure relates to window blind devices and more particularly pertains to a new window blind device for remotely controlling vertical window blinds.

SUMMARY OF THE DISCLOSURE

An embodiment of the disclosure meets the needs presented above by generally comprising an elongated housing having an elongated opening. An elongated track having spaced channels is coupled to and positioned in the housing above the opening in the housing. Each of a plurality of rollers has a pair of spaced wheels positioned in a pair of channels of the track. Each of a plurality of blinds is coupled to the rollers. A telescopic arm is positioned in the housing extending in laterally parallel spaced relationship to the track. The telescopic arm is coupled to each of the rollers to distribute the rollers in spaced relationship along the track. An extension motor retracts and extends the telescopic arm. A remote control is operationally coupled to the extension motor for selectively actuating the extension motor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
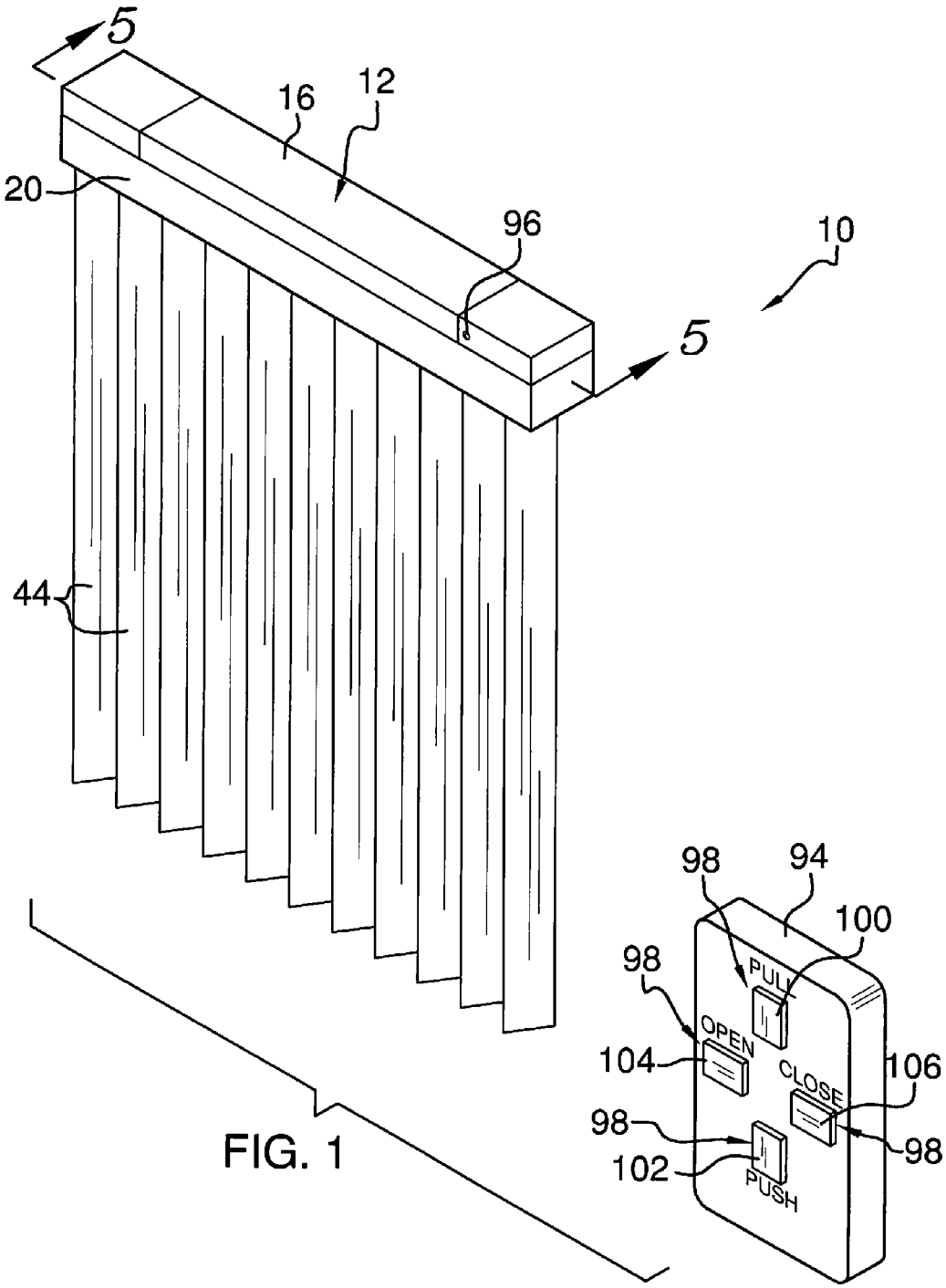
FIG. 1 is a top front side perspective view of a vertical window blind assembly according to an embodiment of the disclosure.
Figure 2:
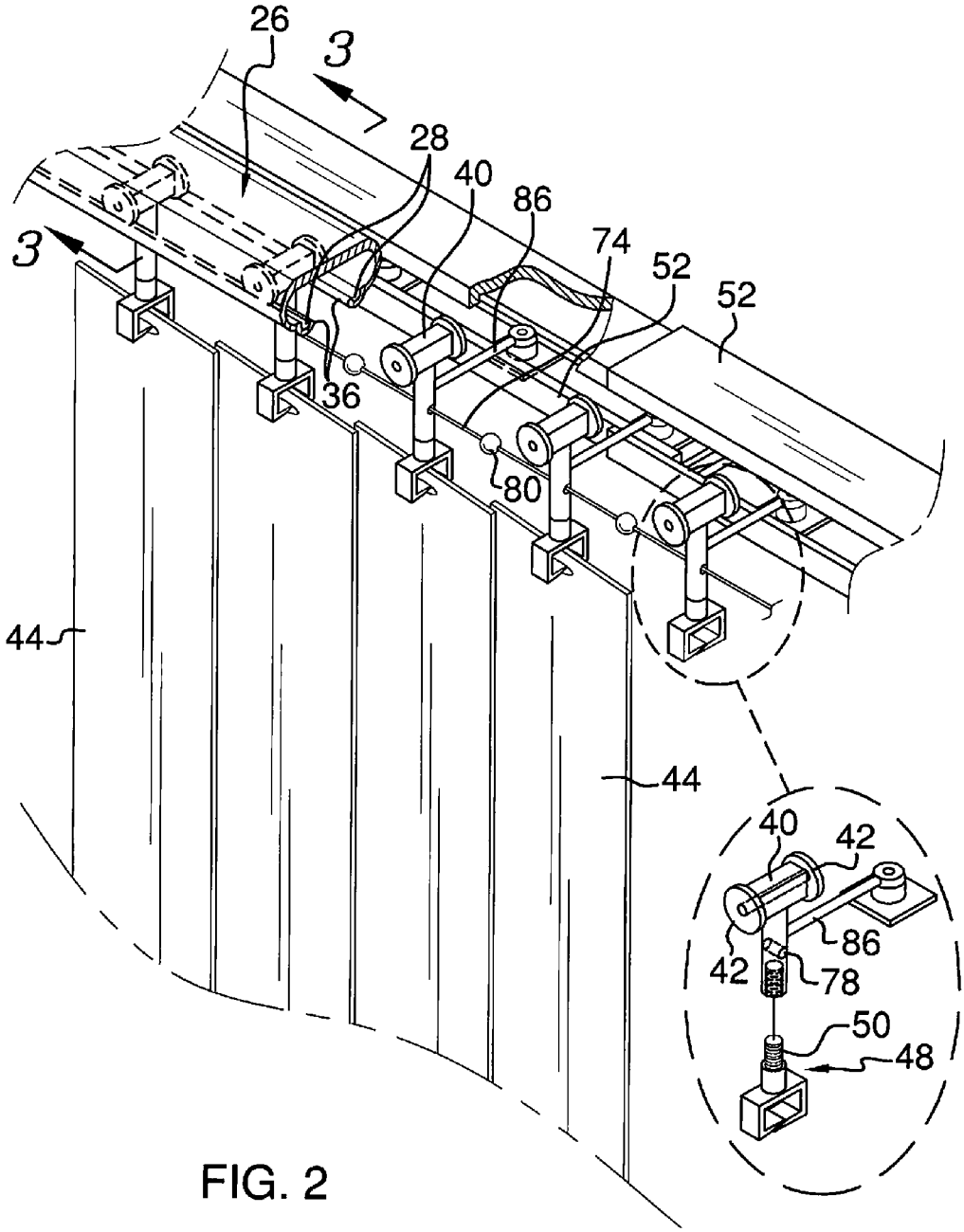
FIG. 2 is a partial cut-away top front side perspective view of an embodiment of the disclosure.
Figure 3:
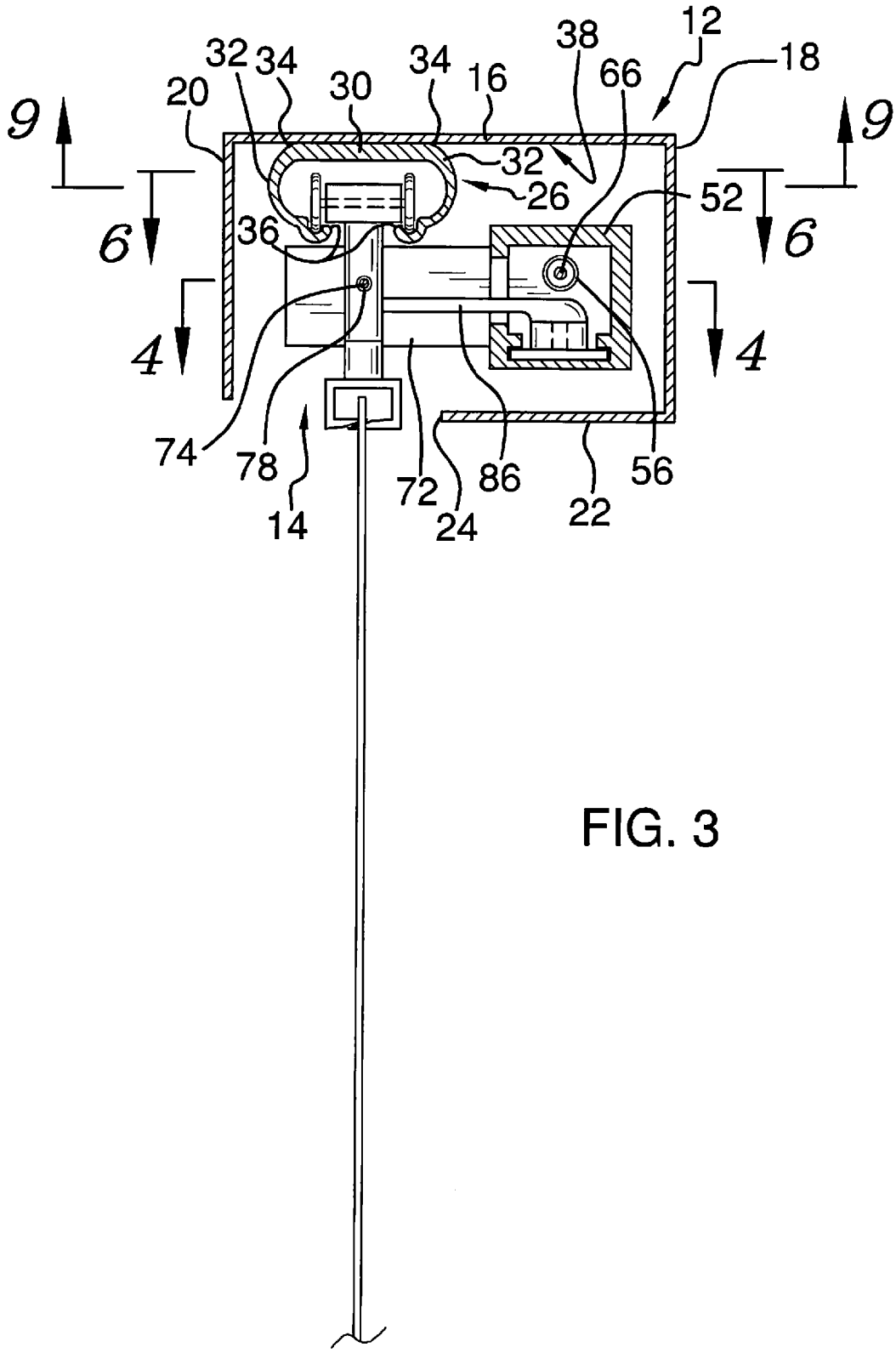
FIG. 3 is a cross-sectional view of an embodiment of the disclosure taken along line 3-3 of FIG. 2.
Figure 4:
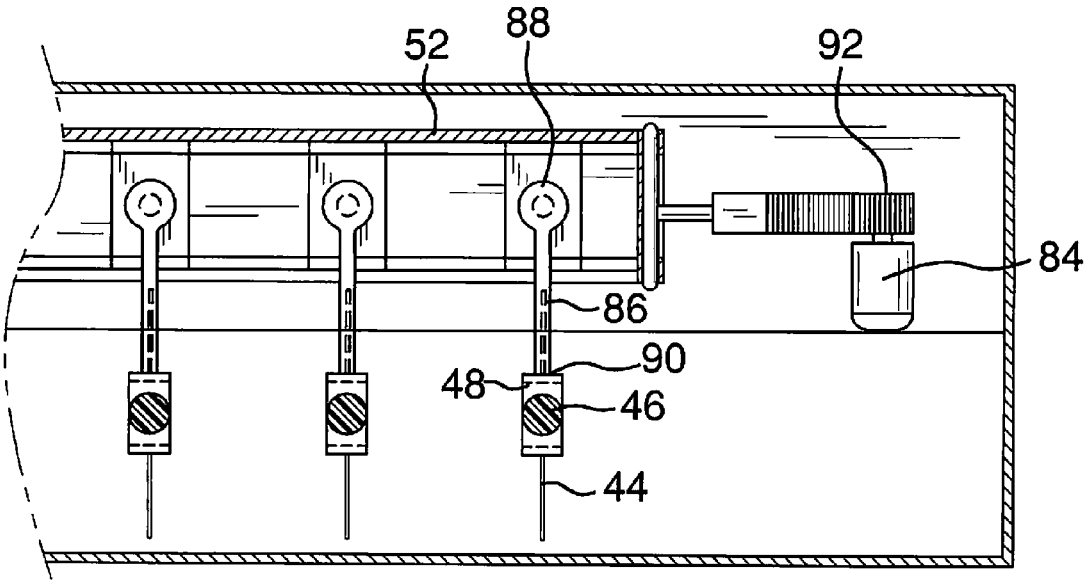
FIG. 4 is a cross-sectional view of an embodiment of the disclosure taken along line 4-4 of FIG. 3.
Figure 5:
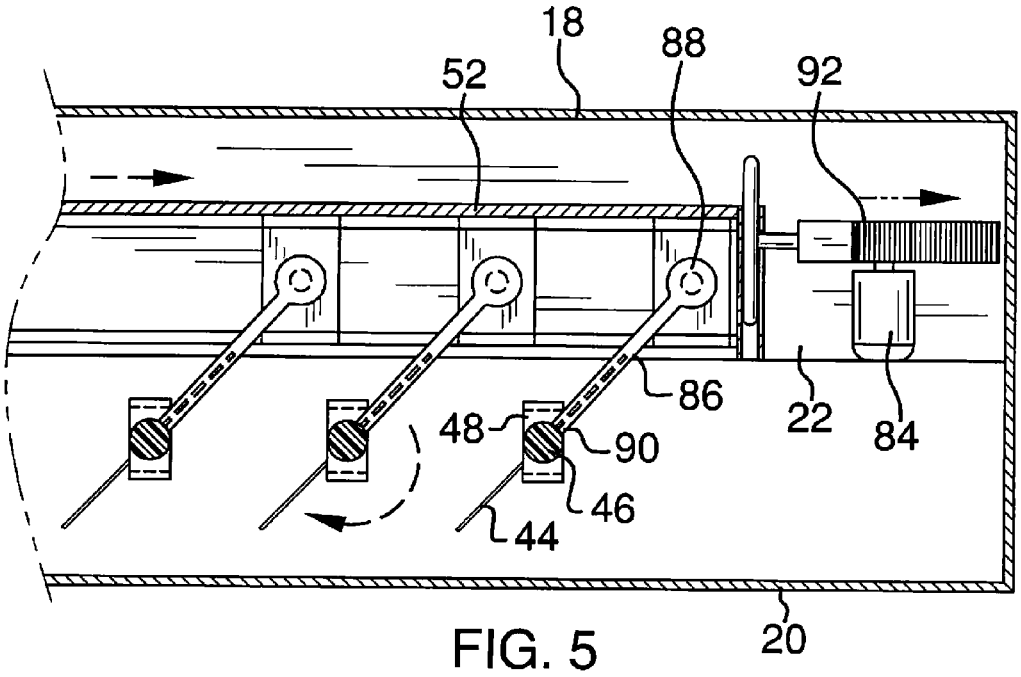
FIG. 5 is a cross-sectional view of an embodiment of the disclosure similar to FIG. 4 but in a pivoted position.
Figure 6:
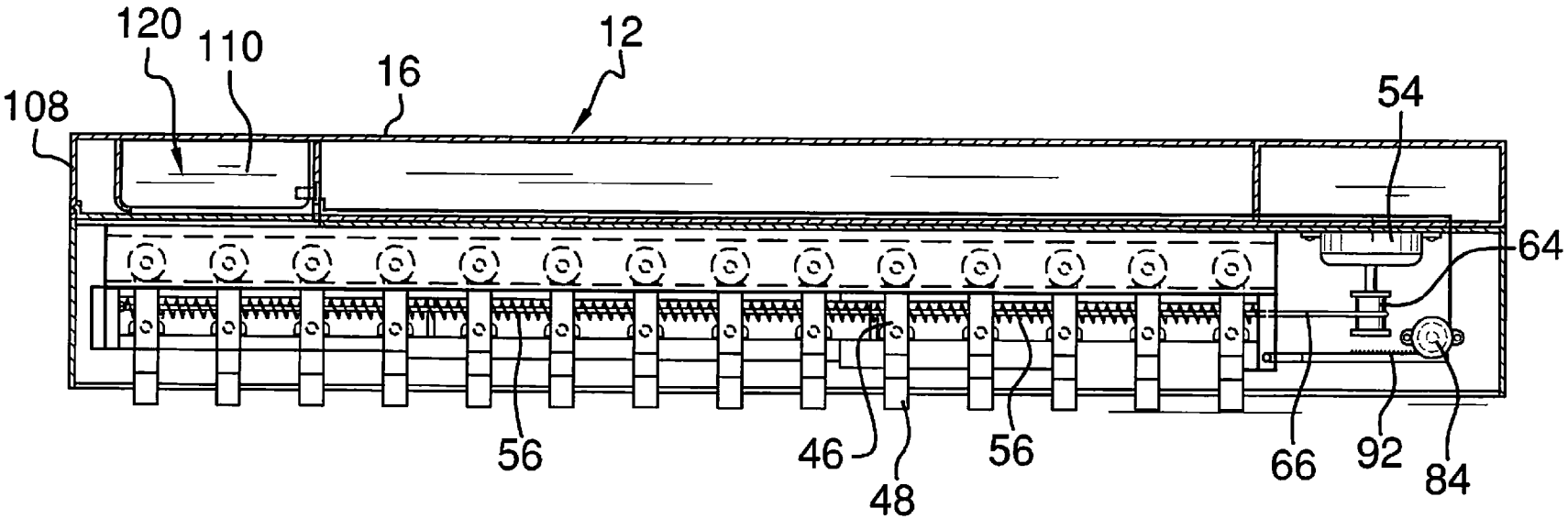
FIG. 6 is a cross-sectional view of an embodiment of the disclosure taken along line 6-6 of FIG. 1.
Figure 7:
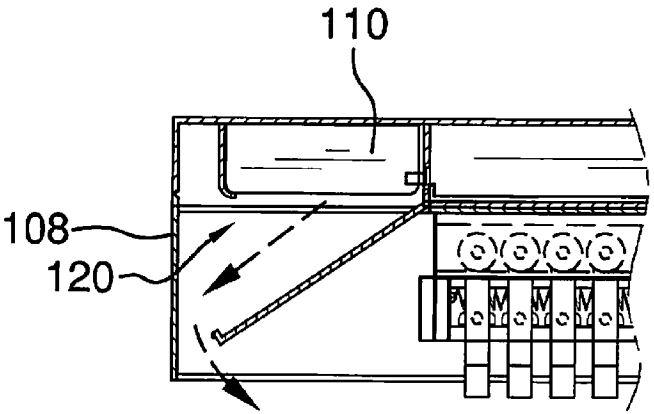
FIG. 7 is a cross-sectional view of an embodiment of the disclosure similar to FIG. 6 but in a partially retracted position.
Figure 8:
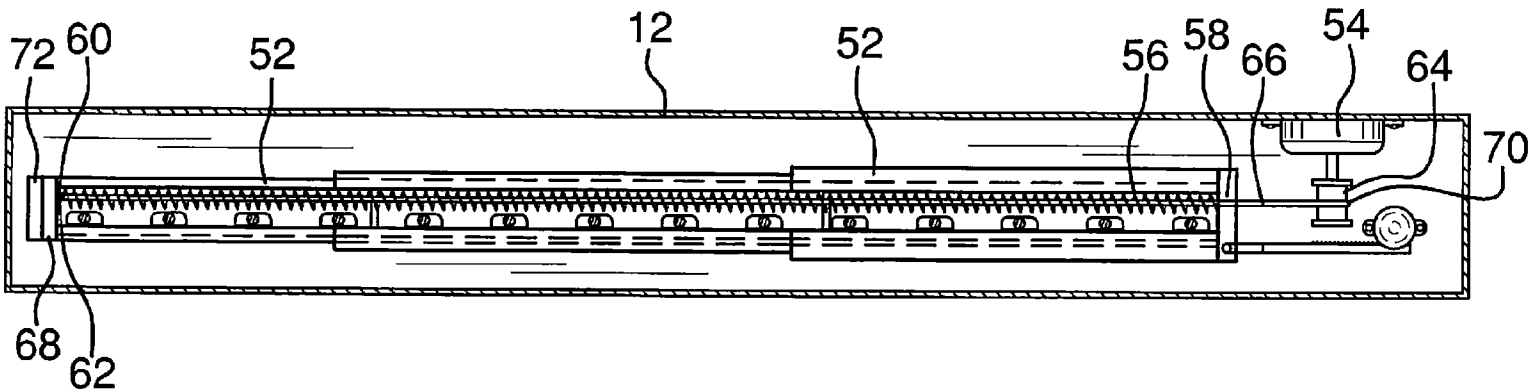
FIG. 8 is a cross-sectional view of an embodiment of the disclosure taken along line 8-8 of FIG. 1.
Figure 9:
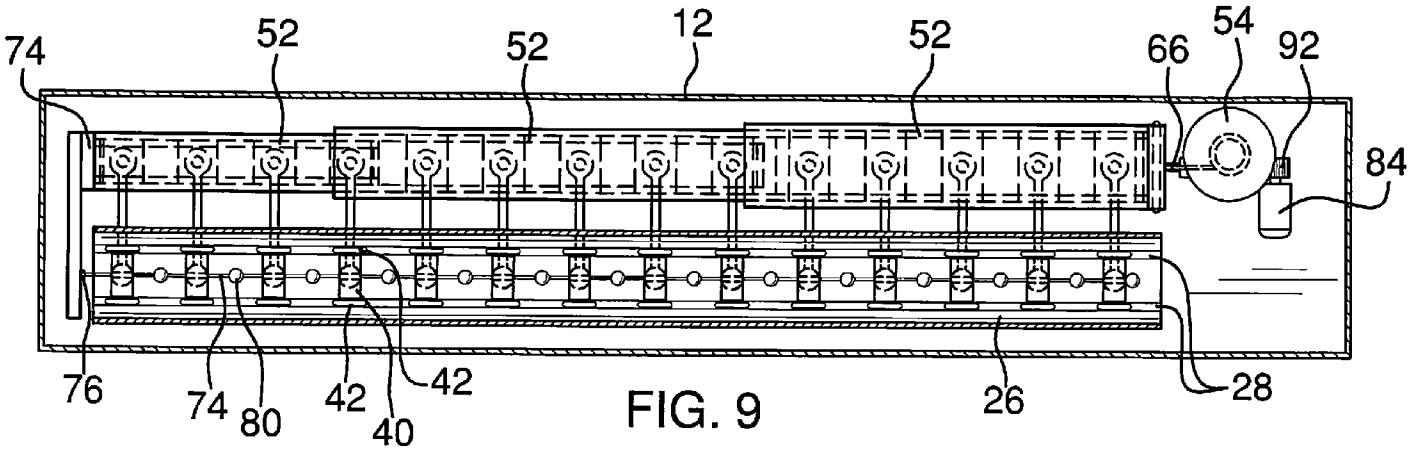
FIG. 9 is a cross-sectional view of an embodiment of the disclosure taken along line 9-9 of FIG. 3.
Figure 10:
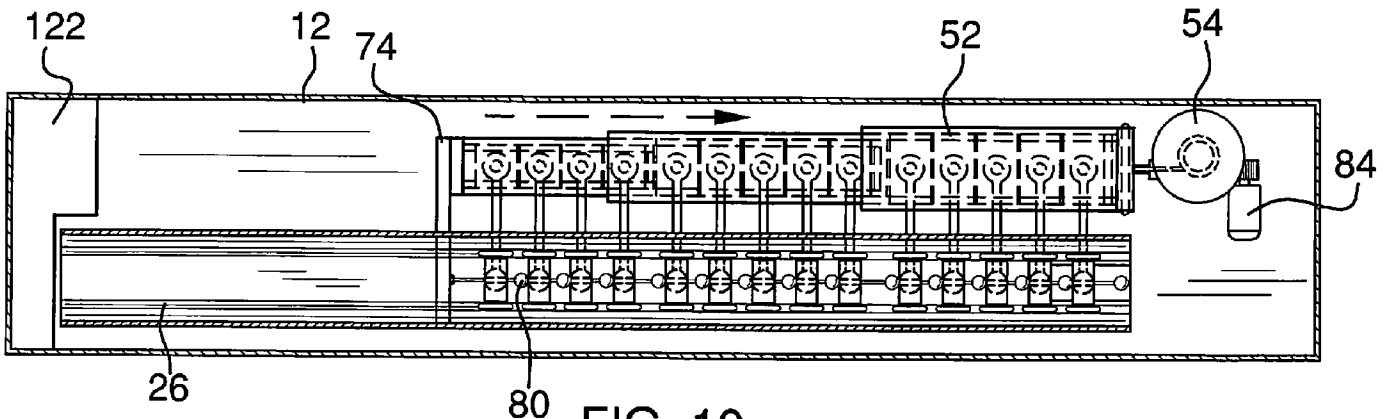
FIG. 10 is a cross-sectional view of an embodiment of the disclosure similar to FIG. 9 but in a retracted position.

With reference now to the drawings, and in particular to FIGS. 1 through 12 thereof, a new window blind device embodying the principles and concepts of an embodiment of the disclosure and generally designated by the reference numeral 10 will be described.

As best illustrated in FIGS. 1 through 12, the vertical window blind assembly 10 generally comprises an elongated housing 12 having an elongated opening 14. The housing 12 has a top wall 16, a back wall 18, a front wall 20 and a bottom wall 22. The front wall 20 and the back wall 18 each extend downwardly from the top wall 16. The bottom wall 22 extends forwardly from the back wall 18. The bottom wall 22 has a free edge 24 positioned in spaced relationship to the front wall 20 defining the opening 14 in the housing 12. An elongated track 26 is coupled to and positioned in the housing 12 above the opening 14 in the housing 12. The track 26 has a pair of spaced channels 28. The track 26 has an upper wall 30 and a pair of side walls 32 extending downwardly from opposite edges 34 of the upper wall 30. Each channel 28 is coupled to and extends along a distal edge 36 of an associated one of the side walls 32 of the track 26 relative to the upper wall 30. Each of the side walls 32 may be arcuate extending from the edge 34 of the upper wall 30 of the track 26 to the distal edge 36 of the side wall 32. The upper wall 30 of the track 26 is coupled to a bottom surface 38 of the top wall 16 of the housing 12.

A plurality of rollers 40 is positioned in the track 26. Each roller 40 has a pair of spaced wheels 42. Each wheel 42 is positioned in an associated one of the channels 28 of the track 26. A plurality of blinds 44 is provided with each blind 44 being coupled to an associated one of the rollers 40. A plurality of shafts 46 are provide. Each shaft 46 is rotatably coupled to and extends downwardly from an associated one of the rollers 40 towards the opening 14 in the housing 12. A plurality of blind connectors 48 is also provided with each blind connector 48 being coupled to an associated one of the shafts 46 and the blinds 44. Each blind connector 48 may be positioned in the opening 14 in the housing 12 such that the blinds 44 extend down from the housing with minimal spacing. Each blind connector 48 may have a threaded extension 50 selectively engageable to the associated shaft 46 such that the blind connectors 48 may be easily replaced if necessary. Each of the blinds 44 overlaps an adjacently positioned blind 44 when the shafts 46 are rotated to close the blinds 44.

A telescopic arm 52 having nested sleeves is coupled to and positioned in the housing 12. The telescopic arm 52 extends in laterally parallel spaced relationship to the track 26. The telescopic arm 52 is coupled to each of the rollers 40 whereby extension of the telescopic arm 52 distributes the rollers 40 in spaced relationship along the track 26. An extension motor 54 is operationally coupled to the telescopic arm 52 for selectively retracting and extending the telescopic arm 52. A biasing member 56 has a first end 58 proximate to the extension motor 54. The biasing member 56 has a second end 60 proximate a distal end 62 of the telescopic arm 52 relative to the extension motor 54. The biasing member 56 urges the telescopic arm 52 into a fully extended position. A spool 64 is coupled to the extension motor 54. The extension motor 54 selectively rotates the spool 64 when actuated. A retraction line 66 has a first end 68 coupled to the distal end 62 of the telescopic arm 52. The retraction line 66 has a second end 70 engaged to the spool 64 whereby rotating of the spool 64 urges the first end 68 of the retraction line 66 towards the spool 64 whereby the telescopic arm 52 is retracted.

An end cap 72 may be coupled to the distal end 62 of the telescopic arm 52 relative to the extension motor 54. A spacing line 74 has a first end 76 coupled to the end cap 72. The spacing line 74 extends through an aperture 78 of each of the shafts 46. A plurality of engagement members 80 is fixedly coupled to the spacing line 74. The engagement members 80 may be knots, beads or any other member sufficiently large to prevent the member from passing through the aperture 78 in the shaft 46. The members 80 are positioned in spaced relationship along a length of the spacing line 74. Each of the engagement members 80 is positioned adjacent to an associated one of the shafts 46 whereby each engagement member 80 abuts the associated one of the shafts 46 and urges the roller 40 coupled to the associated shaft 46 into an extended position. Thus, the blinds 44 are extended across the housing 12. The engagement members 80 may be evenly spaced along the length of the spacing line 74.

A rotation motor 84 is operationally coupled to the telescopic arm 52. The rotation motor 84 moves the telescopic arm 52 relative to the track 26. A plurality of connection arms 86 is provided with each connection arm 86 having a first end 88 pivotally coupled to the telescopic arm 52 and a second end 90 coupled to an associated one of the rollers 40 through a fixed connection to the shaft 46. Thus, the connection arms 86 rotate the shafts 46 when the telescopic arm 52 is moved by the rotation motor 84. Each shaft 46 rotates the associated blind 44 coupled to the shaft 46. A rack and pinion gear 92 is operationally coupled between the rotation motor 84 and the telescopic arm 52 to provide limited movement preventing over-rotation of the blinds 44.

A remote control 94 is operationally coupled to the extension motor 54 for selectively actuating the extension motor 54. Similarly, the remote control 94 is operationally coupled to the rotation motor 84 for selectively actuating the rotation motor 84. A remote sensor 96 is positioned on and extends through the front wall 20 of the housing 12. The remote sensor 96 is operationally coupled to the extension motor 54 for selectively actuating the extension motor 54 upon detection of manipulation of the remote control 94. Similarly, the remote sensor 96 is operationally coupled to the rotation motor 84. The remote control 94 includes a plurality of operational buttons 98 including a pull button 100 and a push button 102 to extend or retract the blinds 44. The buttons 98 further include an open button 104 and a close button 106 to rotate the blinds 44.

A battery compartment 120 is positioned in the housing 12, the battery compartment 120 is positioned adjacent to a distal end 108 of the housing 12 relative to the extension motor 54. The battery compartment 120 is offset from the track 26 and vertically aligned with the telescopic arm 52 whereby the battery compartment 120 is accessible through an L-shaped door 122 when the telescopic arm 52 is in a retracted position. A battery 110 is positioned in the battery compartment 120 and electrically coupled to the extension motor 54, rotation motor 84, and remote sensor 96.

Figure 11:
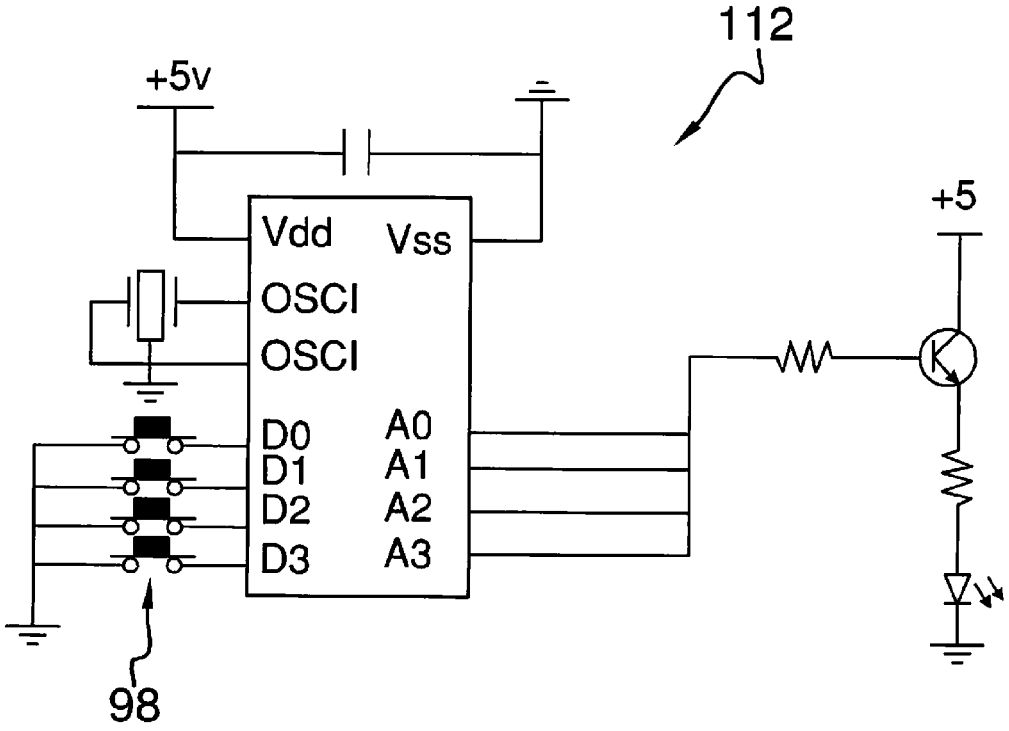
FIG. 11 is a schematic diagram of an embodiment of the disclosure.
Figure 12:
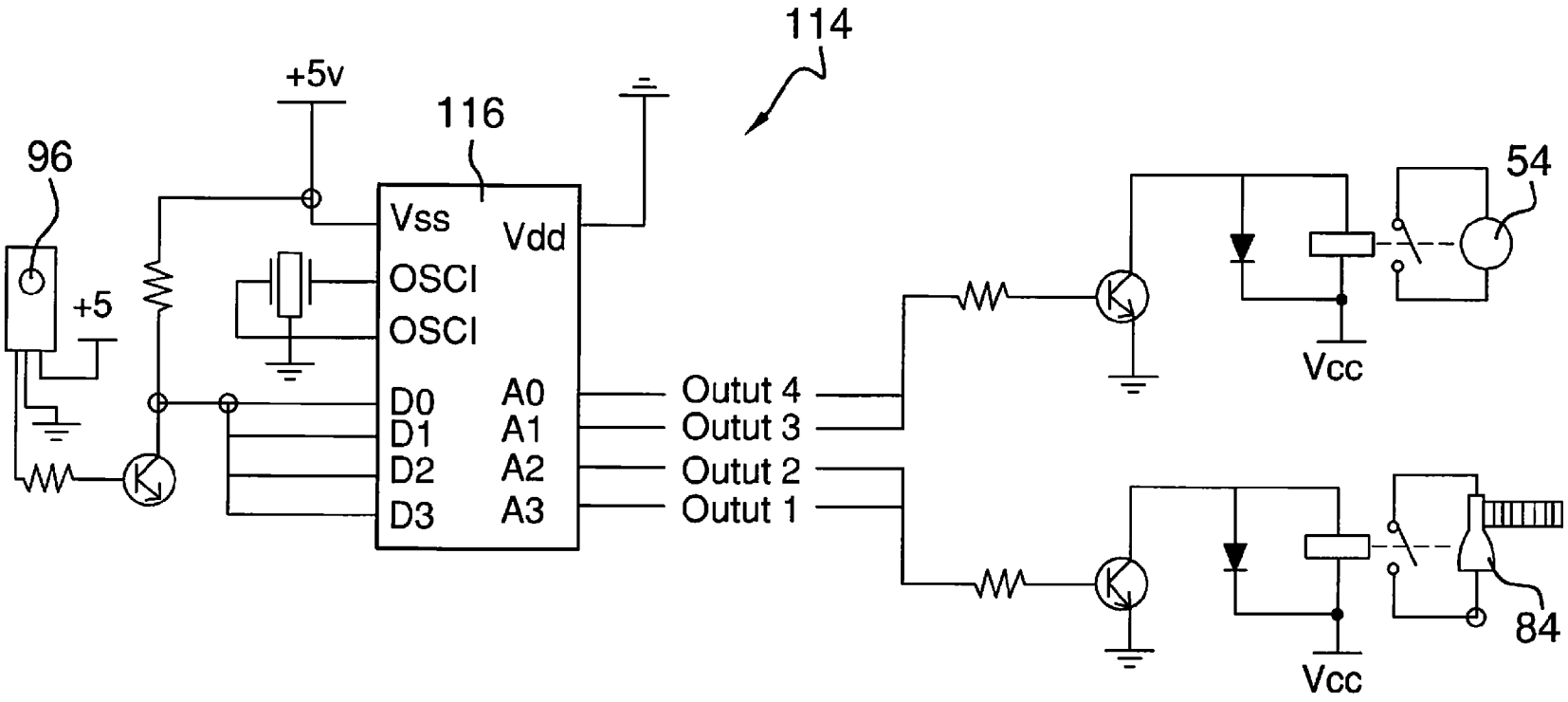
FIG. 12 is a schematic diagram of an embodiment of the disclosure.

FIG. 11 shows an electrical circuit 112 for the remote control 94. FIG. 12 shows an electrical circuit 114 including the remote sensor 96 and a processor 116 for selectively actuating the extension motor 54 and the rotation motor 84.

As shown in FIG. 13, the battery compartment 120 is covered by an L-shaped door 122. The door 122 pivots to provide access to the battery 110 inside the battery compartment 120.

In use, the housing 12 is installed with the blinds 44 extending down from the housing 12. The blinds 44 are extended and retracted along the housing 12 by manipulation of the remote control 94. Rotation of the blinds 44 is also achieved by manipulation of the remote control 94. Thus, the blinds 44 may be opened, closed, and rotated to a desired position from a remote location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A vertical blind assembly comprising:

an elongated housing having an elongated opening;

an elongated track coupled to and positioned in said housing above said opening in said housing, said track having a pair of spaced channels;

a plurality of rollers positioned in said track, each roller having a pair of spaced wheels, each wheel being positioned in an associated one of said channels of said track;

a plurality of blinds, each blind being coupled to an associated one of said rollers;

a telescopic arm coupled to and positioned in said housing, said telescopic arm extending in laterally parallel spaced relationship to said track, said telescopic arm being coupled to each of said rollers whereby extension of said telescopic arm distributes said rollers in spaced relationship along said track;

an extension motor operationally coupled to said telescopic arm for retracting and extending said telescopic arm; and a remote control operationally coupled to said extension motor for selectively actuating said extension motor.

2. The assembly of claim 1, further including a biasing member, said biasing member having a first end proximate to said extension motor, said biasing member having a second end proximate a distal end of said telescopic arm relative to said extension motor, said biasing member urging said telescopic arm into an extended position.

3. The assembly of claim 2, further comprising:

a spool coupled to said extension motor, said extension motor selectively rotating said spool; and a retraction line having a first end coupled to said distal end of said telescopic arm, said retraction line having a second end engaged to said spool whereby rotating of said spool urges said first end of said retraction line towards said spool whereby said telescopic arm is retracted.

4. The assembly of claim 1, further including an end cap coupled to a distal end of said telescopic arm relative to said extension motor.

5. The assembly of claim 4, further comprising:

a spacing line having a first end coupled to said end cap, said spacing line extending through said aperture of each of said shafts; and a plurality of engagement members fixedly coupled in spaced relationship along a length of said spacing line, each of said engagement members being positioned adjacent to an associated one of said shafts whereby each engagement member abuts said associated one of said shafts and urges said roller coupled to said associated shaft into an extended position whereby said blinds are extended across said housing.

6. The assembly of claim 1, further including a plurality of shafts, each shaft being rotatably coupled to and extending downwardly from an associated one of said rollers towards said opening in said housing.

7. The assembly of claim 6, further including a plurality of blind connectors, each said blind connector being coupled to an associated one of said shafts, each blind connector being positioned in said opening in said housing.

8. The assembly of claim 7, further including each blind connector having a threaded extension, said threaded extension being selectively engageable to said associated shaft.

9. The assembly of claim 5, wherein said engagement members are evenly spaced along said length of said spacing line.

10. The assembly of claim 6, wherein each said blind overlaps an adjacently positioned blind when said shafts are rotated.

11. The assembly of claim 6, further comprising:

a rotation motor operationally coupled to said telescopic arm, said rotation motor moving said telescopic arm relative to said track;

a plurality of connection arms, each connection arm having a first end pivotally coupled to said telescopic arm and a second end coupled to an associated one of said rollers whereby said connection arms rotate said shafts when said telescopic arm is moved by said rotation motor, each said shaft rotating said associated blind coupled to said shaft; and said remote control being operationally coupled to said rotation motor for selectively actuating said rotation motor.

12. The assembly of claim 11, further including a rack and pinion gear operationally coupled between said rotation motor and said telescopic arm.

13. The assembly of claim 1, further including said housing having a top wall, a back wall, a front wall and a bottom wall, said front wall and said back wall each extending downwardly from said top wall, said bottom wall extending forwardly from said back wall, said bottom wall having a free edge in spaced relationship to said front wall defining said opening in said housing.

14. The assembly of claim 13, further including an upper wall of said track being coupled to a bottom surface of said top wall of said housing.

15. The assembly of claim 1, further including said track having an upper wall and a pair of side walls extending downwardly from opposite edges of said upper wall, each said channel being coupled to and extending along a free edge of an associated one of said side walls of said track.

16. The assembly of claim 15, further including each of said side walls of said track being arcuate extending from said edge of said upper wall of said track to said free edge of said side wall.

17. The assembly of claim 1, further comprising:

a battery compartment positioned in said housing, and a battery positioned in said battery compartment, said battery being electrically coupled to said first motor.

18. The assembly of claim 17, further including said battery compartment being positioned adjacent to a distal end of said housing relative to said extension motor, said battery compartment being offset from said track and vertically aligned with said telescopic arm whereby said battery compartment is accessible when said telescopic arm is in a retracted position.

19. The assembly of claim 13, further including a remote sensor, said remote sensor being positioned on and extending through said front wall of said housing, said remote sensor being operationally coupled to said extension motor for selectively actuating said extension motor upon detection of manipulation of said remote control.

20. A vertical blind assembly comprising:

an elongated housing having an elongated opening, said housing having a top wall, a back wall, a front wall and a bottom wall, said front wall and said back wall each extending downwardly from said top wall, said bottom wall extending forwardly from said back wall, said bottom wall having a free edge in spaced relationship to said front wall defining said opening in said housing;

an elongated track coupled to and positioned in said housing above said opening in said housing, said track having a pair of spaced channels, said track having an upper wall and a pair of side walls extending downwardly from opposite edges of said upper wall, each said channel being coupled to and extending along a free edge of an associated one of said side walls of said track, each of said side walls of said track being arcuate extending from said edge of said upper wall of said track to said free edge of said side wall, said upper wall of said track being coupled to a bottom surface of said top wall of said housing;

a plurality of rollers positioned in said track, each roller having a pair of spaced wheels, each wheel being positioned in an associated one of said channels of said track;

a plurality of blinds, each blind being coupled to an associated one of said rollers;

a telescopic arm coupled to and positioned in said housing, said telescopic arm extending in laterally parallel spaced relationship to said track, said telescopic arm being coupled to each of said rollers whereby extension of said telescopic arm distributes said rollers in spaced relationship along said track;

an extension motor operationally coupled to said telescopic arm for retracting and extending said telescopic arm;

a biasing member, said biasing member having a first end proximate to said extension motor, said biasing member having a second end proximate a distal end of said telescopic arm relative to said extension motor, said biasing member urging said telescopic arm into an extended position;

a spool coupled to said extension motor, said extension motor selectively rotating said spool;

a retraction line having a first end coupled to said distal end of said telescopic arm, said retraction line having a second end engaged to said spool whereby rotating of said spool urges said first end of said retraction line towards said spool whereby said telescopic arm is retracted;

an end cap coupled to a distal end of said telescopic arm relative to said extension motor;

a spacing line having a first end coupled to said end cap, said spacing line extending through said aperture of each of said shafts;

a plurality of engagement members fixedly coupled in spaced relationship along a length of said spacing line, each of said engagement members being positioned adjacent to an associated one of said shafts whereby each engagement member abuts said associated one of said shafts and urges said roller coupled to said associated shaft into an extended position whereby said blinds are extended across said housing, said engagement members being evenly spaced along said length of said spacing line;

a plurality of shafts, each shaft being rotatably coupled to and extending downwardly from an associated one of said rollers towards said opening in said housing, each of said blinds overlapping an adjacently positioned blind when said shafts are rotated;

a plurality of blind connectors, each said blind connector being coupled to an associated one of said shafts, each blind connector being positioned in said opening in said housing, each blind connector having a threaded extension, said threaded extension being selectively engageable to said associated shaft;

a rotation motor operationally coupled to said telescopic arm, said rotation motor moving said telescopic arm relative to said track;

a plurality of connection arms, each connection arm having a first end pivotally coupled to said telescopic arm and a second end coupled to an associated one of said rollers whereby said connection arms rotate said shafts when said telescopic arm is moved by said rotation motor, each said shaft rotating said associated blind coupled to said shaft;

a remote control operationally coupled to said extension motor for selectively actuating said extension motor, said remote control being operationally coupled to said rotation motor for selectively actuating said rotation motor;

a rack and pinion gear operationally coupled between said rotation motor and said telescopic arm;

a battery compartment positioned in said housing, said battery compartment being positioned adjacent to a distal end of said housing relative to said extension motor, said battery compartment being offset from said track and vertically aligned with said telescopic arm whereby said battery compartment is accessible when said telescopic arm is in a retracted position;

a battery positioned in said battery compartment, said battery being electrically coupled to said first motor; and a remote sensor, said remote sensor being positioned on and extending through said front wall of said housing, said remote sensor being operationally coupled to said extension motor for selectively actuating said extension motor upon detection of manipulation of said remote control.

* * * * *